US006606801B2

(12) United States Patent
Strang et al.

(10) Patent No.: US 6,606,801 B2
(45) Date of Patent: Aug. 19, 2003

(54) SYSTEM AND PROCESS FOR DRYING A SHOE

(75) Inventors: Janine Morgens Strang, Cincinnati, OH (US); Ilya Yurievich Ilyin, St. Petersburg (RU); Viatcheslav Vladimirovitch Karamychev, St. Petersburg (RU); Valeriy Valentinovich Pavlov, St. Petersburg (RU); Michael Peter Siklosi, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 128 days.

(21) Appl. No.: 09/891,846

(22) Filed: Jun. 26, 2001

(65) Prior Publication Data

US 2002/0040534 A1 Apr. 11, 2002

Related U.S. Application Data

(60) Provisional application No. 60/214,634, filed on Jun. 28, 2000.

(51) Int. Cl.[7] ..... F26B 3/00

(52) U.S. Cl. ..... 34/437; 34/104; 34/201; 34/202; 34/235; 34/439

(58) Field of Search ..... 34/104, 437, 439, 34/201, 202, 235

(56) References Cited

U.S. PATENT DOCUMENTS

| | | | | | |
|---|---|---|---|---|---|
| 4,754,769 | A | * | 7/1988 | Flynn | 132/73.5 |
| 4,967,060 | A | * | 10/1990 | Lomeli | 392/384 |
| 5,666,743 | A | * | 9/1997 | Dawson | 34/219 |
| 5,729,908 | A | | 3/1998 | Braden | 34/104 |
| 5,930,913 | A | | 8/1999 | Liao et al. | 34/104 |

FOREIGN PATENT DOCUMENTS

| | | | | | |
|---|---|---|---|---|---|
| FR | 2761874 | | 10/1998 | | |
| JP | 01037999 | A | * | 2/1989 | 34/202 |

* cited by examiner

*Primary Examiner*—Denise L. Esquivel
*Assistant Examiner*—Kathryn S. O'Malley
(74) *Attorney, Agent, or Firm*—Dinsmore & Shohl LLP

(57) ABSTRACT

A system and process for drying a shoe, for example a leather shoe comprising a fan operable to produce an air flow, a heating element and at least one duct having at least one outlet, which is adapted to direct a portion of the air flow into a shoe. Additionally, the shoe drying system provides a drying effectiveness of at least 70 g/hr within the first hour of drying.

27 Claims, 5 Drawing Sheets

SYSTEM AND PROCESS FOR DRYING A SHOE

This application claims the benefit of the filing date of provisional U.S. patent application Ser. No. 60/214,634, filed Jun. 28, 2000.

FIELD OF THE INVENTION

The present invention relates to drying a shoe, and more particularly, to a system and process for drying a shoe, for example a leather shoe.

BACKGROUND OF THE INVENTION

Many people clean their athletic shoes in a conventional clothes washing machine. This process, known as immersion cleaning, induces higher water retention than typically incurred in normal wear activities such as rain or snow. Immersion cleaning processes, hereby incorporated herein by reference, are described in pending U.S. application Ser. Nos. 60/202,291 filed May 5, 2000; 60/161,240 filed Oct. 22, 1999; 60/161,187 filed Oct. 22, 1999; 60/161,151 filed Oct. 22, 1999; 60/161,118 filed Oct. 22, 1999; 60/198,019 filed Apr. 18, 2000; and 60/198,507 filed Apr. 18, 2000. Although processes and systems have been developed for drying processes. Thus, there is a need for a device that is capable of efficiently drying a shoe, for example a leather shoe, that has undergone an immersion cleaning process.

One of the problems associated with drying a shoe that has undergone an immersion cleaning process is that the known processes are often slow and sometimes require extended drying times. For example, one of the more common means of drying a shoe is through a device that forces hot air into the shoe's interior. This type of device can require two or more hours to wearably dry a shoe that has been immersed. Therefore, it would be desirable to reduce the drying time for shoes that have undergone an immersion cleaning process and have retained high levels of water.

A similar problem associated with drying shoes is that most processes dry the interior of the shoe without regard to drying the exterior surface of the shoe. An undried exterior shoe surface can undesirably make the shoe more prone to re-soiling and consequently require additional wash treatments. This puts the shoe at risk for unnecessary wear and tear. As a result, it is also desirable to dry the exterior surfaces of a shoe, which may aid in prolonging its life.

Finally, conventional clothes dryers are sometimes used after the immersion cleaning process to facilitate the drying of a shoe. The disadvantage of this known drying process, especially with respect to leather shoes, is that the dryer promotes unnecessary wear and tear on the shoe through degradation of shoe quality, undesirable changes in appearance or shrinkage. Consequently, it would be desirable to reduce the negative effects associated with the shoe drying process.

In sum, it would be advantageous to have a system and/or process that reduces the drying time for a shoe. It would also be advantageous to have a system and/or process that satisfactory dries the outside surface of the shoe. Lastly, it would be advantageous to have a system and/or process that reduces negative effects associated with conventional drying processes.

SUMMARY OF THE INVENTION

Accordingly, it is an object of the present invention to provide improved systems, processes and apparatuses for drying a shoe. More particularly, it is an object of the present invention to provide systems, processes and apparatuses for reducing the drying time associated with shoes that have been subjected to an immersion cleaning process. In one embodiment of the present invention, a shoe drying system comprises a fan operable to produce an air flow, a heating element and at least one duct having at least one outlet, which is adapted to direct a portion of the air flow into a shoe. Additionally, the shoe drying system provides a drying effectiveness of at least 70 g/hr within the first hour of drying.

In an alternative embodiment of the present invention, a process for drying a shoe comprises the steps of providing a shoe and providing a drying system. The drying system comprises a fan operable to produce an airflow, a heating element and at least one duct having at least one outlet. Next, the duct is inserted into the shoe and an airflow is directed to the interior of the shoe. Additionally, the drying system has a drying effectiveness of at least 70 g/hr within the first hour of drying.

One advantage of certain embodiments of the present invention is that they provide for accelerated drying of a shoe that has undergone an immersion cleaning process. For example, in the specific embodiments described herein, the shoe drying systems and processes reduce the time to wearably dry shoes. In specific embodiments, the systems and processes also dry the exterior of a shoe and reduce negative effects associated with most known processes.

Still other advantages and novel features of the present invention will become apparent to those skilled in the art from the following detailed description, which simply illustrates various modes contemplated for carrying out the invention. As will be realized, the invention is capable of other different obvious aspects, all without departing from the invention. Accordingly, the drawings and descriptions are illustrative in nature and not restrictive.

BRIEF DESCRIPTION OF THE DRAWINGS

While the specification concludes with claims particularly pointing out and distinctly claiming the present invention, it is believed that the same will be better understood from the following description, taken in conjunction with the accompanying drawings, in which:

DETAILED DESCRIPTION

Reference will now be made in detail to various embodiments of the invention, examples of which are illustrated in the accompanying drawings, wherein like numerals indicate the same element throughout the views.

Figure 1:
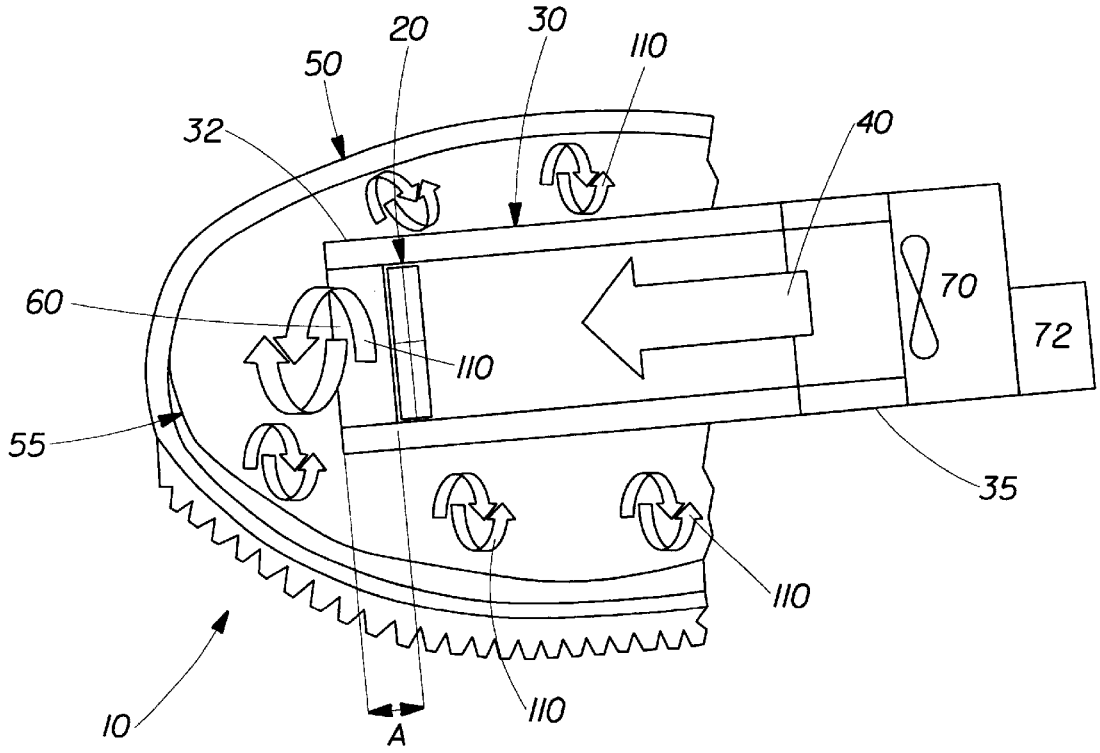
FIG. 1 depicts a schematic view of a shoe drying system according to one embodiment of the present invention, inserted in a shoe.

FIG. 1 depicts a schematic of a shoe drying system 10 in accordance with one embodiment of the present invention.

As illustrated in this embodiment, the shoe drying system 10 includes a turbulence generator 20, a duct 30, a fan 70 operable to provide an air flow 40 and an outlet 60. The system is adapted for use in a shoe 50 as shown. Additionally, the air flow 40 that is generated by the fan 70 is laminar as it flows through the duct 30.

A distal end 32 of the duct 30 rests in the shoe 50 so that the air outlet 60 faces the shoe toe. The turbulence generator 20 is arranged in duct 30 and increases the turbulence of the air flow 40 that is generated by the fan 70. In essence, as the turbulent air exits the duct 30, it flows along the longitudinal length of the shoe 50 and destabilizes the boundary layer of air at the inner surface of the shoe 50. Once destabilized, the boundary layer of air is replaced with hot, dry air. This process accelerates drying time due to the increased heat and mass transfer that occurs on the interior surfaces 55 of the shoe 50.

In a specific embodiment of the invention, turbulence generator 20 is located a distance A within the distal end 32 of duct 30. More specifically, distance A is about 10% of the diameter of the duct 30.

A proximal end 35 of the duct 30 is attached to the fan 70. In one embodiment, the fan 70 is provided with a heating element 72 to generate a warm or hot laminar air flow 40. For example, in an embodiment of the present invention, a conventional fan and heater combination employ a hair dryer. Such a fan and heater combination preferably produces a temperature not greater than about 55 EC (about 130 EF), more preferably about 43 EC to about 54 EC (about 110 EF to about 130 EF), most preferably about 49 EC to about 52 EC (about 120 EF to about 125 EF). Temperatures significantly above about 55 EC have the potential to cause shrinkage or otherwise degrade the quality of a shoe, especially a leather shoe.

In one embodiment, the fan 70 is operable to provide an air flow 40 at a rate of about 500 feet per minute (fpm) to about 4000 fpm, or from about 150 meters per minute (mpm) and about 1220 mpm. Air flow 40 substantially above this range does not further accelerate the drying process and air flow 40 substantially below this range may not be not strong enough to be affected by the turbulence generator 20. In an embodiment of the invention, a Rowenta Protect hair dryer generates an air flow of about 450 mpm to about 700 mpm.

Figure 2A:
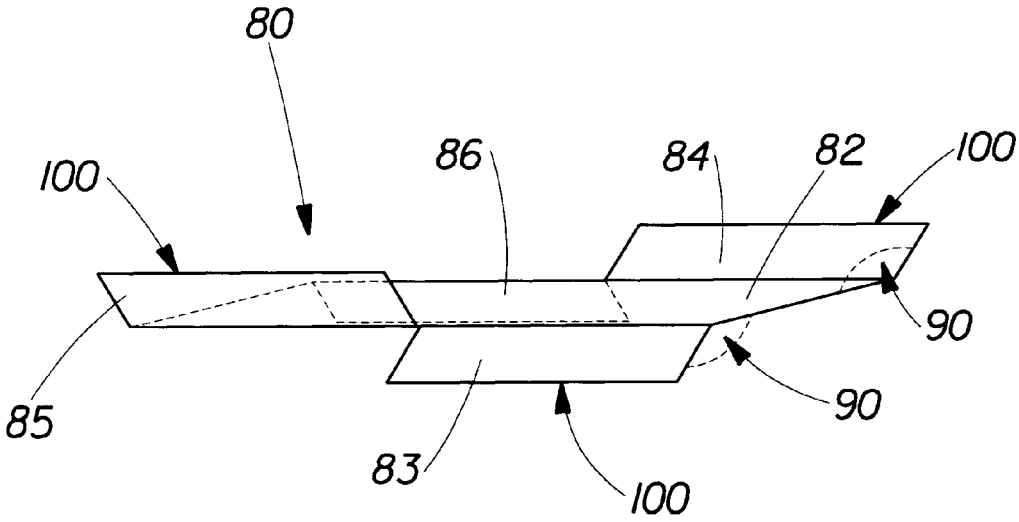
FIGS. 2*a* and 2*b* depict a turbulence generator.
Figure 2B:
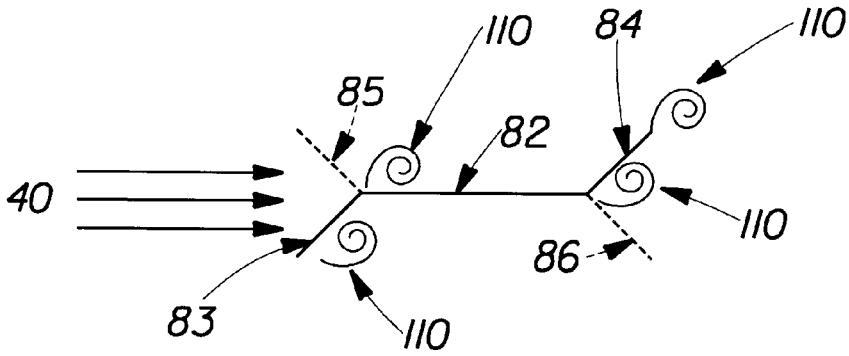

Although the turbulence generator 20 can be any suitable system that creates turbulence from laminar air flow 40, the following is a non-limiting embodiment of the invention. The turbulence generator 20 comprises a fixed-bladed device 80 as shown in FIG. 2*a*, including a planar portion 82 and outwardly extending flanges 83, 84, 85, and 86. The obtuse angles 90 formed by the intersection of planar portion 82 and flanges 83, 84, 85 and 86, respectively can be of varying angles from about 90 E to about 180 E. The edges 100 of flanges 83, 84, 85 and 86, respectively, in combination with the obtuse angles 90 of the fixed-bladed device 80, create turbulence in the form of vortexes 110 as air flow 40 passes through the duct 30 and out the air outlet 60. FIG. 2*b* shows the vortexes 110 being created as the air flow 40 passes over the fixed-bladed device.

While a fixed-bladed system 80 is described, higher-multiple blade devices (i.e. 3 blades, 4 blades, etc.), or non-fixed bladed (i.e. a propeller) devices may also be employed. An increase in the number of blades may improve vortex formation 110, but may also intensify air drag. As a result, the mass exchange and the drying process may become less effective.

Figure 3:
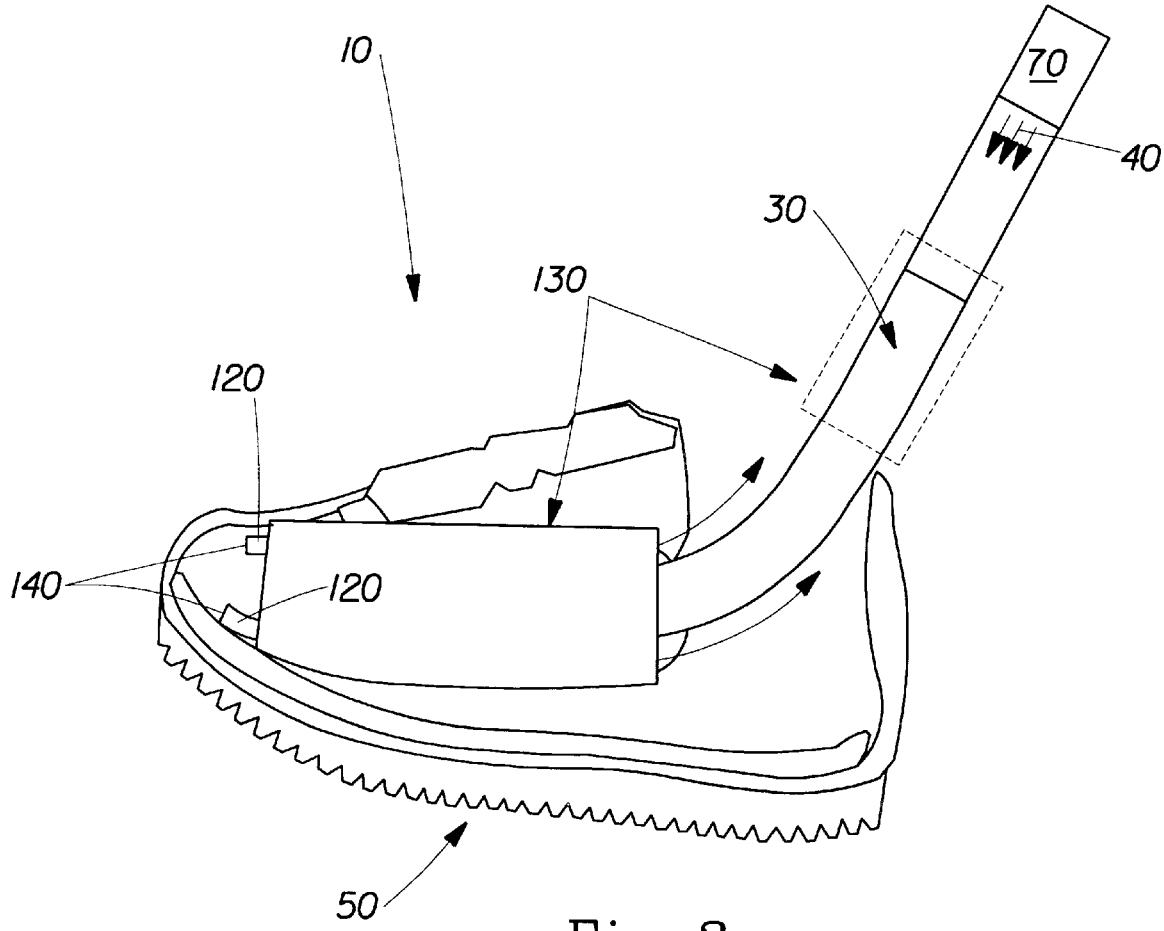
FIG. 3 depicts a schematic view of another embodiment of a shoe drying system according to the present invention, inserted in a cutaway-shoe.

FIG. 3 depicts a view of a shoe drying system 10 incorporating a plurality of flexible tubes 120 according to one embodiment of the present invention. As illustrated in this embodiment, the shoe drying system 10 further includes a shield 130, a duct 30, and a fan 70 for providing an airflow 40. The flexible tubes 120 each have an air outlet 140 and extend from the duct 30.

In the engaged position, as shown in FIG. 3, the shield 130 is resting in a shoe 50 and is encasing the duct 30 and each of the flexible tubes 120. The shield 130 is holding each of the flexible tubes 120 so the air outlets 140 are facing toward the shoe toe. As FIG. 3 also demonstrates, the shield is moveable along the longitudinal axis of the duct 30 by an operator. The phantom position of the shield 130 in FIG. 3 demonstrates an embodiment of the shoe drying system 10 in its operable position.

The flexible tubes 120 may comprise any configuration and arrangement that promotes drying air distribution. In one embodiment, the flexible tubes 120 also absorb or promote the capillary attraction of retained water from the inner surface of the shoe 50. In particular, the plurality of flexible tubes 120 may be provided with a hydrophilic covering that promotes absorption or capillary attraction of water from the shoe.

Preferably, the flexible tubes 120 can cumulatively absorb from about 10 g to about 60 g of water from the shoe, and more preferably can absorb about 20 g to about 40 g of water from the shoe. An example of the hydrophilic covering is hereby incorporated herein by reference, as described in U.S. Pat. No. 5,200,248 by Thompson, et al.

Additionally, although a number of combinations of flexible tubes 120 can be incorporated into the system, one specific embodiment incorporates about 5 to about 20 of the flexible tubes 120, with each tube having a diameter of about 5 mm to about 15 mm and a length of about 2 cm to about 10 cm. Limiting the size and the number of the flexible tubes 120 may prevent heat build-up in duct 30, which may cause the temperature of the shoe to exceed the recommended 55 EC temperature for leather shoes. Further, a minimum number of tubes 120 are recommended to aid the capillary attraction of water, which accelerates drying of the shoe 50.

Figure 4A:
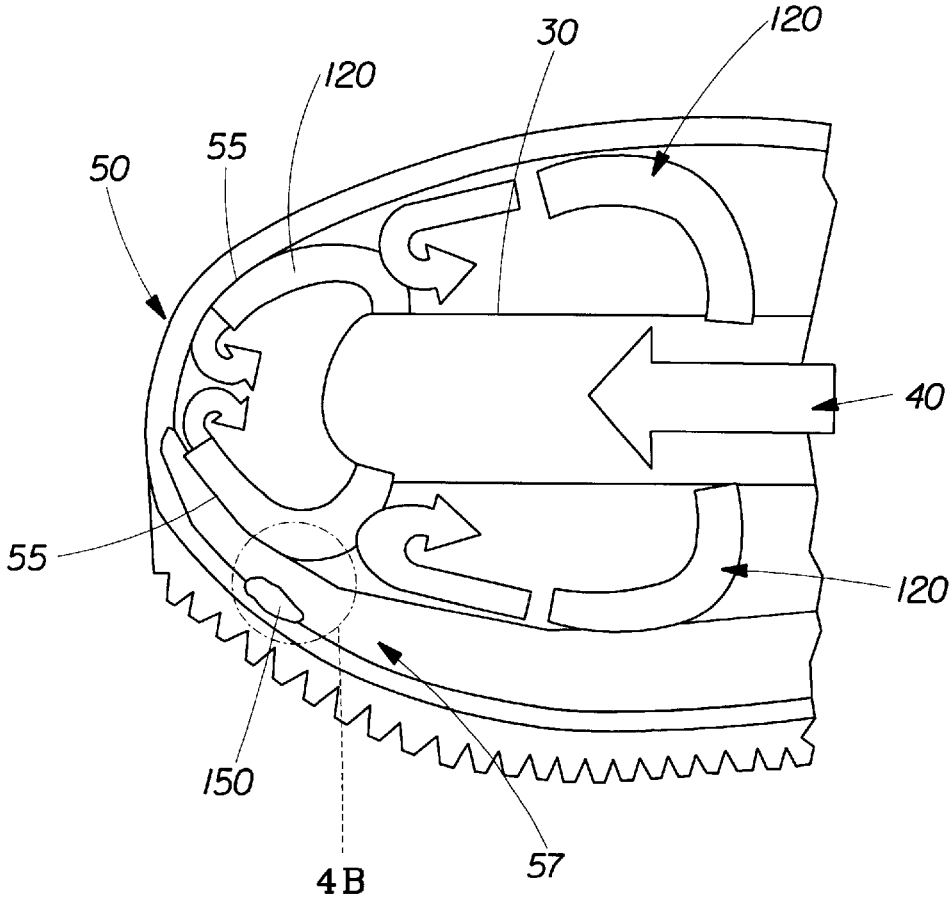
FIG. 4*a* depicts a partial view of yet another embodiment of a shoe drying system according to the invention.

As demonstrated in FIG. 4*a,* with the shield 130 no longer resting in the shoe 50, the flexible tubes 120 are free to move within the shoe interior. In one embodiment of the invention, the flexible tubes 120 inflate when the fan 70 is operated. In this embodiment, air outlets 140 are of sufficient diameter to allow the flexible tubes 120 to inflate and press against and come in contact with the interior surfaces 55 of the shoe 50. In another embodiment, the flexible tubes 120 are made from a flexible tubing, such as TYGON® tubing, which has a natural spring-like action. As a result, once the shield 130 has moved along the longitudinal axis of the duct 30, the flexible tubes 120 press against and come in contact with the interior surfaces 55 of the shoe 50.

Figure 4B:
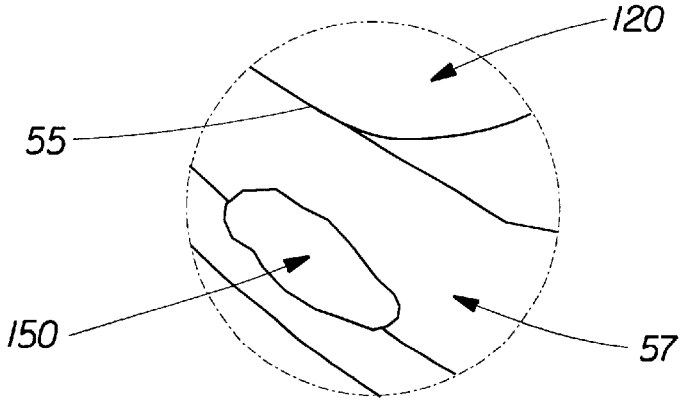
FIG. 4*b* depicts an exploded view of a partial view of FIG. 4*a;*.

As shown in FIG. 4*b,* in either of the above mentioned embodiments, the flexible tubes 120 press against and come in contact with the interior surfaces 55 of the shoe 50, to reduce the formation of air cavities 150 between layers of the shoe's lining 57. Moreover, the contact between the hydrophilic covering on the tubes 120 and the internal shoe surfaces facilitates the capillary attraction or absorption of retained water from the shoe's interior. The water distributed to the flexible tubes 120 due to the capillary attraction or absorption enlarges the evaporation area, which results in an accelerated drying process.

Importantly, the above embodiments are not mutually exclusive of one another. In other words, it is possible to incorporate both the turbulence generator 20 and the flexible tubes 120 on duct 30. Moreover, the present invention is not limited to drying one shoe at a time. For example, duct 30 could be partitioned so the air flow 40 vents to multiple shoes.

Figure 5:
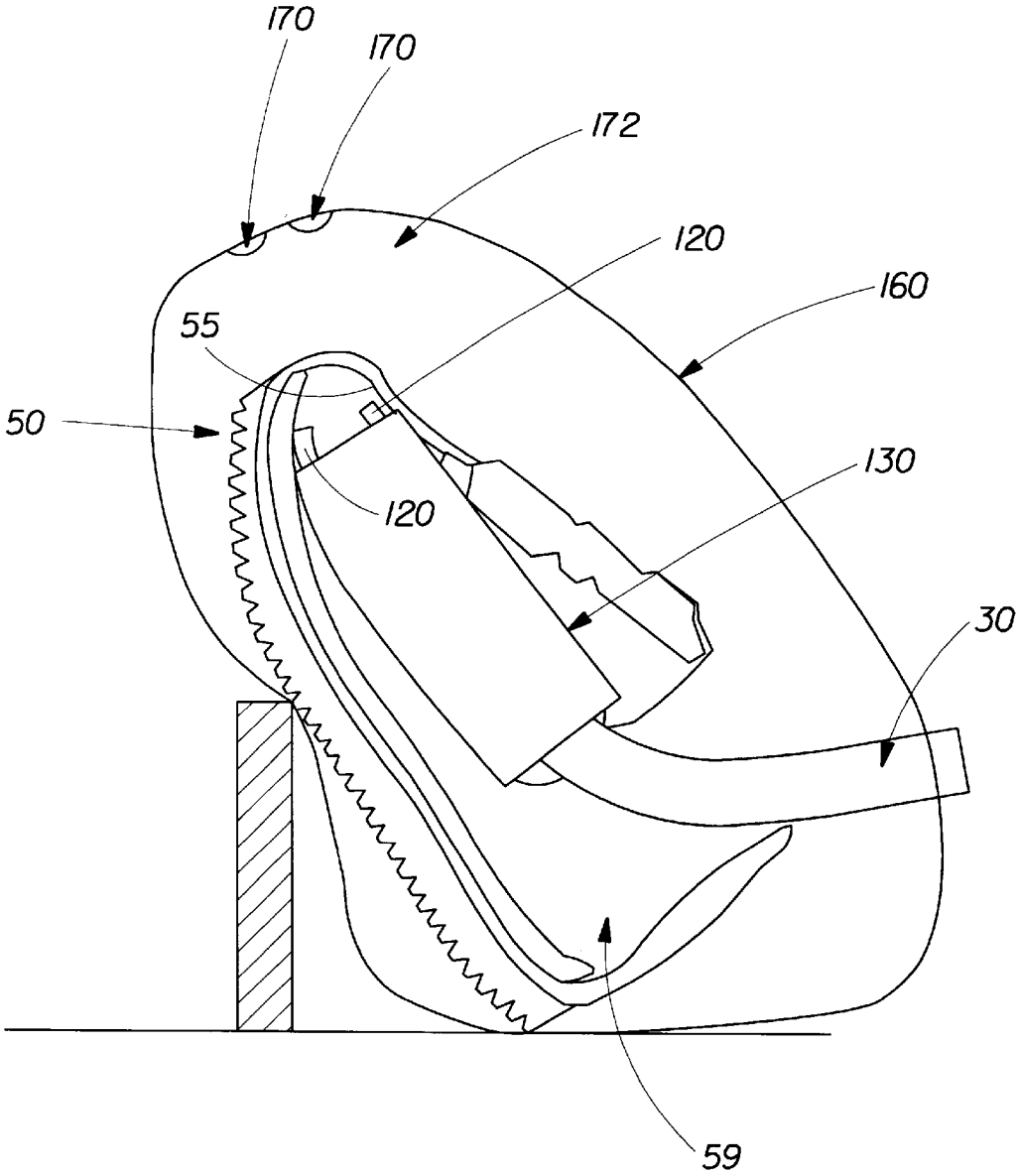
FIG. 5 depicts a schematic view of a shoe drying system according to the present invention.

FIG. 5 depicts a shoe drying system 10 including a vented bag 160 for drying the external surfaces of a shoe 50. The duct 30 rests in shoe 50 and the shoe is encompassed by the vented bag 160. As previously described, air flow 40 flows through duct 30 and exits into shoe 50, either through the air outlet 60 associated with the turbulence generator 20 or through the air outlets 140 associated with the flexible tubes 120. The air flow 40 flows through the longitudinal length of shoe 50 and vents into the vented bag 160 through the shoe top opening. The vented bag 160 contains apertures 170, which allow airflow to escape vented bag 160 into an open environment. Consequently, the air flow 40 within the vented bag 160 circulates over the shoe 50 allowing the exterior surfaces 59 to dry.

The dimensions of the vented bag 160 can vary, depending on the type and size of shoes 50 to be dried. For example, a bag can be provided that is sufficient to contain a low-top leather running shoe, a high-top cross trainer or a even pair of shoes to be dried simultaneously. Preferably, bags 160 should be sufficient in size to accommodate a leather shoe 50, without being so large as to prevent the circulating air from contacting the exterior surfaces 59 of the shoe 50. In other words, the bag should be sufficiently small so the air flow 40 circulating within the vented bag 160 contacts the outside surfaces 59 of the shoe 50.

Additionally, the vented bag 160 is preferably flexible, yet also preferably durable enough to withstand multiple uses. In a non-limiting embodiment of the present invention, the vented bag 160 is made of a flexible plastic and has an uninflated volume of about 40 cm3 (about 45 cm length, about 23 cm width and about 0.40 mm thick), comprising four apertures 170 having a diameter of about 7 mm or an area of about 38 $mm^2$. Additionally, the vented bag 160, as well as the other components of the shoe drying system, should be heat-resistant and capable of withstanding temperatures of at least about 55 EC (about 130 EF).

Although apertures 170 on the vented bag 160 can be of multiple dimensions and locations, the apertures 170 should be of sufficient diameter to allow the vented bag 160 to inflate. In an embodiment of the present invention, the apertures 170 should be located adjacent the distal end 172 of the vented bag 160, or near the toe of the shoe 50. In this way, the airflow 40 is allowed to circulate over the entire exterior surface 59 of the shoe before exiting the vented bag 160. Finally, in an embodiment of the present invention, the air exiting the vented bag 160 through apertures 170 should be about 20% relative humidity.

Moreover, as also demonstrated in FIG. 5, it is advantageous that the shoe 50 rest in an upward position (i.e. toe elevated above heel) during the drying process. This allows gravity to pull water from the toe toward the heel, thereby expanding the evaporation area and accelerating the drying process. Maintaining the shoe 50 in an upright position allows the airflow 40 to flow along the longitudinal interior surfaces 55 of the shoe 50 before exiting to the vented bag 160 and then circulate over the external surface 59 of the shoe before exiting the bag 160 to the environment. This process helps ensure an accelerated and more uniform drying process with respect to the exterior shoe surface 59.

The foregoing description of the various embodiments of the invention have been presented for purposes of illustration and description. It is not intended to be exhaustive or to limit the invention to the precise form disclosed. Many alternatives, modifications and variations will be apparent to those skilled in the art of the above teachings.

For example, a wide variety of bases could be used for the shoe drying system, as long as the air flow to each shoe is sufficient to wearably dry each shoe. Additionally, a variety of bases could be adapted to hold a plurality of shoes or a single shoe based on a configuration the user desires. Additionally, the bases could house a single fan 70 or multiple fans for drying purposes. For example, in one embodiment, a fan 70, attached to duct 30 could be partitioned into a shape like the letter "Y", with an air outlet 60 at each branch of the "Y" to accommodate a shoe 50.

Moreover, a plurality of end shapes for the air outlet 60 is also feasible and alternative shaped outlets 60 may better direct air flow or better adapt to a particular shoe size. For example, a fan-like opening, such as currently used in a Bunsen burner, would enable the air flow to cover a wide area of the inner toe. A further example is a rounded end to better accommodate the shape of the shoe. Additionally, it is not required that all the air flow exit from the air outlet 60. It may be possible to achieve similar results with air flow directed to other areas of the shoe, as long as a majority of the air flow is directed toward the inner toe.

EXAMPLES

The following examples demonstrate various embodiments of the invention:

Example 1

Relative Humidity

Five-pairs of shoes are subjected to an immersion cleaning process and dried using a system according to the invention. A scale is employed as a means to correlate dryness with the relative humidity of air exiting the vented bag (shown in Table 1, column 2: 0=not dry, 0.5=slightly damp, 0.75=very slightly damp, 1=dry). At various intervals, the relative humidity of the air exiting the vented bag is recorded and the shoe is tested for dryness. A shoe's dryness is determined by walking in the shoe for approximately 10 steps with a thin pair of socks as well as by placing a bare hand inside the shoe 50 to check for moisture content. The following types of shoes are employed:

- Pair #1: New Balance M615SB, size 9 EE (men's), running shoes, leather
- Pair #2: Reebok Classic Leather WT, size 9 (women's), casual shoe, leather
- Pair #3: New Balance MW571WT, size 9.5 (men's), walking shoe, leather
- Pair #4: Nike Walker ASII plus, size 9 (men's), walking shoe, leather
- Pair #5: Easy Spirit Harbor, size 10.5 AA (women's), casual walking shoe, suede The immersion cleaning is preformed in a Kenmore washer with a warm city water wash, and cold rinse using liquid TIDE® with Bleach Alternative as the detergent. The drying system comprises a Remington hair dryer operated at low heat/high air setting and connected with PVC tubing and directed toward the toe of the respective shoe. Each shoe is placed in a vented bag about 46 cm in length, with four apertures at the distal end of the bag (near the toe), each being about 7 mm in diameter. A Cole Parmer Tri-Sense meter measures the relative humidity of the air escaping from the vented bag at various stages of the drying cycle.

The results are set forth in Table 1:

TABLE 1

| Shoe ID (R = right) (L = left) | Wearability/Dryness Rating 1 = dry 0 = wet | % Relative Humidity (or air escaping from vented bag) |
|---|---|---|
| 2L | 0.00 | 23.9 |
| 3L | 0.00 | 28.1 |
| Avg. at Wearability = 0 (wet, not wearable) | 0.00 | 26% RH |
| 2R | 0.50 | 18.8 |
| 3R | 0.50 | 18.7 |
| Avg. at Wearability = 0.5 (Borderline wearable) | 0.50 | 18.75% RH |
| 1R | 0.75 | 17 |
| 2L | 0.75 | 13.7 |
| 4R | 0.75 | 17.7 |
| 4L | 0.75 | 17.3 |
| Avg. at Wearability = 0.75 (wearable, v. sl. damp to touch) | 0.75 | 16.4% RH |
| 1L | 1.00 | 11.1 |
| 2R | 1.00 | 11.7 |
| 3L | 1.00 | 12.1 |
| 3R | 1.00 | 14.6 |
| 1R | 1.00 | 20.1 |
| 1L | 1.00 | 20.6 |
| 5R | 1.00 | 25.9 |
| Avg. at Wearability = 1.0 (wearable, dry to touch) | 1.0 | 16.6% RH |

0.00 = wet inside, not wearable
0.50 = slightly damp inside, borderline wearable
0.75 = very slightly damp, wearable
1.00 = dry inside, wearable As demonstrated in Table 1, after subjecting the shoes to the immersion cleaning process, and beginning the drying process, the relative humidity exiting the vented bag 160 is monitored. Note also that each shoe ID is a separate shoe experiment. In other words, shoe ID "1L" is two separate shoe tests, where in one test the shoe was considered dry when the relative humidity exiting the vented bag was about 11% and in the next experiment the shoe was considered dry even though the relative humidity exiting the bag was about 20%.

As shown in test shoe 2L and 3L, a relative humidity in the mid-20% range correlates with a wet, non-wearable shoe denoted by a "0" in the middle column. Test shoes 2R and 3R, having a relative humidity of about 18%, correlates with a slightly damp shoe denoted by a "0.50" in middle column. Test shoes 1R, 2L, 4R and 4L having an average relative humidity of 16.4%, correlates with a very slightly damp, wearable shoe denoting a "0.75" rating. Finally, the remainder of the samples demonstrate that an average humidity in the 16% range correlates with a dry, wearable shoe, denoted by a "1". It should be noted that Shoe 5R, is a suede shoe, rather than the preferable leather embodiment. This shoe's high relative humidity, which somewhat skews the data, is attributable to the fact that a leather exterior should dry much faster than suede. Consequently, had this data point been excluded, the relative humidity percentage would have been in the 15% range.

Continuing, where the dryness rating is equal to "1" and the shoes are considered wearable, the relative humidity readings vary from about 11% to about 20%. Shoes are also considered wearable (i.e. 0.75), or borderline wearable (i.e. 0.50) when the relative humidity is about 17% to about 19%. Relative humidity readings above about 20% show that the shoes are still wet and need additional drying time. As a result, a relative humidity of air exiting the vented bag (160) of about 20% should denote a wearable leather shoe.

Example 2

Wearably Dry

An important aspect of the present invention is the determination of "wearably dry". Typically, for purposes of the present invention, less than about 50 g, more preferably less than about 40 g, most preferably less than about 30 g of water remain in the shoe after the drying process denotes a wearably dry shoe. An experiment is conducted wherein 19 panelists are assigned one of thirteen models of shoes ranging in dry weight from about 275 g to about 525 g, having an average weight of about 397 g. Each panelist's dry shoe weight in grams (g) is recorded and the shoe is treated to numerous wash/dry cycles and following each wash cycle, the shoe is dried until the panelist determines that the shoe is wearable. After the panelist determines the shoe is wearable, the shoe is weighed to determine the amount (g) of water left in the shoe. A total of 108 tests were performed.

Table 2 shows a summary of the data collected:

TABLE 2

| g water/g shoe after drying treatment | Count Considered Wearable | % Considered Wearable | g water for avg. shoe (397.2 g) |
|---|---|---|---|
| >= 0.001092896 < 0.03 | 17 | 15.7% | 0.43 to < 11.9 g |
| >= 0.03 < 0.059 | 40 | 37.0% | 11.9 to < 23.4 g |
| >= 0.059 < 0.088 | 38 | 35.2% | 23.4 to < 35.0 g |
| >= 0.088 < 0.117 | 11 | 10.2% | 35.0 to < 46.5 g |
| >= 0.117 <= 0.148307226 | 2 | 1.9% | 46.5 to 58.8 g |
| Total | 108 | 100% | |

Column 1 of Table 2 shows the ranges of grams of water left in the shoe, when wearably dry, divided by the dried shoe weight. Column 2 shows the number of samples falling within the parameters of the respective ranges in Column 1. Column 3 shows the percentage of the samples falling within the parameters of the respective ranges, based on the total number of samples. Column 4 multiples the average dried shoe weight of 397.2 g by the values in Column 1 to determine the average grams of water left in the shoe. For example, of the 108 total samples, 2 were determined to be wearably dry when the grams of water left in the shoe divided by the dried shoe weight fell between 0.117 and 0.148 g water/ g shoe. This implies that in 2% of the samples, the shoe is wearably dry when it contains between about 46.5 g and about 58.8 g water. Continuing, the data shows that in 51 of the 108 observations, or that in about 47% of the samples the shoe is wearably dry when it contains from about 23.4 g to about 58.8 g of water. Conversely, if a shoe contains more than 59 g of water, the shoe is not considered wearably dry. Whether the above ranges are viewed on an absolute basis (i.e. less than 50 g, more preferably less than 40 g, most preferably less than 30 g of water remain in the shoe after the drying process) or on a normalized basis (i.e. less than 0.126 g water/g shoe, more preferably less than 0.10 g/water/g shoe, most preferably less than 0.075 g water/g shoe), they define the scope of "wearably dry" within the present invention.

Example 3

Model Shoe

A further refinement to the wearably dry test in Example 2 is based on a model shoe: the Adidas Superstar II (U.S. men's sizes 11 and 11.5, average dry weight 431.3 g and comprise a leather upper, a "textile" lining, and a rubber outer sole). In particular, the model shoe is first subjected to an immersion cleaning process to determined the average amount of water retained in the process. An immersion cleaning process using a Kenmore series 90 washing machine with City water and about a 30 EC (90 EF) wash followed by about a 20 EC (70 EF) rinse is employed. Continuing, four shoes per load are washed on a heavy duty cycle using 30 g of liquid TIDE® with Bleach alternative. On average, the model shoe gains about 120 g of water, but in some instances the model shoe gains as much as about 175 g of water.

Following the immersion cleaning process, the shoes are dried until a participant considers them wearably dry. As demonstrated in Table 3, about 47 g of water,or about 0.10 g water/g shoe, can remain in the model shoe and still be considered wearably dry (this value falls within the absolute preferable range of less than 50 g of water remaining in the shoe, and falls within the preferable normalized range of 0.10 to 75 g water/g shoe). As a result, on average about 73 g (120 g–47 g) of water must be removed from the model shoe for the shoe to be considered wearably dry.

TABLE 3

| Panelist | Water remaining in shoe after drying treatment (g) | Wearable? Y/N |
|---|---|---|
| 1 | 27.5 | Y |
| 2 | 27.9 | Y |
| 1 | 29.2 | Y |
| 2 | 31.1 | Y |
| 1 | 31.4 | Y |
| 3 | 34.3 | Y |
| 1 | 35.0 | Y |
| 1 | 35.6 | Y |
| 1 | 37.8 | Y |
| 2 | 46.0 | Y |
| 2 | 46.7 | Y |
| 2 | 47.1 | Y |
| | | sl. Damp |
| 1 | 48.8 | N |
| | | made sock wet |
| 1 | 54.3 | N |
| 1 | 67.6 | N |
| 1 | 70.3 | N |

Example 4

Drying Effectiveness

In an embodiment of the present invention, dying effectiveness of the aforementioned shoe drying systems, is determined by subtracting water left in the shoe after one-hour of drying at a temperature of about 55 EC. The model shoe's weight is recorded both prior to and subsequent to an immersion cleaning process with the difference in values being the grams of water gained due to the immersion cleaning. The shoes are then dried using a system and process according to the invention or with a stand alone hair dryer and weighed at various intervals throughout the drying process. Table 4 shows the drying effectiveness associated with alternative embodiments of present invention and with a hair dryer on a stand alone basis.

On average, either embodiment of the present invention dries the model shoe to a wearably dry state within one hour from initiating the drying process. Note that in all three experiments, the grams of water remaining in the shoe at one hour were derived through interpolation. For example in Column 2, at 50 minutes, the shoe utilizing the flexible tubes has about 62 g of water remaining in the shoe. At 70 minutes, the shoe has about 26 g of water remaining in the shoe. As a result, after 60 minutes of drying, interpolation suggests that the shoe has about 44 g of water remaining.

TABLE 4

| | Turbulence Generating Device | Flexible Tubes | Hair Dryer |
|---|---|---|---|
| g of water gained | 127 g | 121 g | 121 g |
| g of water remaining after: | | | |
| 10 min | | 102 g | |
| 11 min | | | 92 g |
| 18 min | 82 g | | |
| 30 min | 64 g | 79 g | 69 g |
| 39 min | 58 g | | |
| 50 min | 52 g | 62 g | |
| 52 min | | | 55 g |
| 60 min* | 47 g | 44 g | 52 g |
| 63 min | 45 g | | |
| 68 min | | | 48 g |
| 70 min | | 26 g | |

*interpolated

As Table 4 shows, the embodiment comprising the turbulence generating device 20 has a drying effectiveness of about 80 g/hr (about 127 g–about 47 g) and the embodiment comprising the flexible tubes 120 has drying effectiveness of about 77 g/hr (about 121 g–about 44 g). The third column of Table 4 shows that the drying effectiveness of the stand alone hair dryer has a drying effectiveness of about 69 g/hr (about 121 g–about 52 g). Consequently, either embodiment of the present invention has a drying effectiveness greater than that of a stand alone hair dryer and either embodiment has a drying effectiveness of at least about 70 g/hr.

Moreover, variations in temperature, airflow, turbulence and water retention affect the drying effectiveness of a shoe drying system and have the potential to increase the drying effectiveness to 120 g/hr.

Having shown and described the preferred embodiments of the present invention, further adaptions of the system and process for drying a shoe herein can be accomplished by appropriate modifications by one of ordinary skill in the art without departing from the scope of the present invention. Accordingly, the scope of the present invention should be considered in terms of the following claims and is understood not to be limited to the details of structure and operation shown and described in the specification and drawings.

What is claimed is:

1. A system for drying a shoe, comprising:

a fan operable to produce an air flow;

a heating element;

at least one duct having at least one outlet configured to be positioned within the shoe and adapted to direct at least a portion of the air flow into the shoe, and said duct further comprising at least one tube extending from the duct and configured to be positioned within the shoe;

wherein said system provides a drying effectiveness of at least 70 g/hr within the first hour of drying.

2. The system of claim 1, wherein said drying effectiveness is between 70 g/hr and about 120 g/hr.

3. The system of claim 1, wherein the temperature of the airflow at said outlet is less than about 55° C.

4. The system of claim 1, wherein the airflow is between about 500 fpm and about 4000 fpm.

5. The system of claim 1, further comprising a vented bag for receiving a shoe and said duct.

6. The system of claim 1, further comprising a second duct for directing at least a portion of the air flow into a second shoe, said other duct having an outlet.

7. The system of claim 1, further comprising a turbulence generating device at least partially within said duct.

8. The system of claim 7, wherein said turbulence generating device comprises a blade.

9. The system of claim 7, further comprising a plurality of tubes extending from said duct.

10. The system of claim 1, wherein the tube is configured to inflate upon airflow entering the tube.

11. The system of claim 1, wherein said tube is configured to absorb retained water from the interior surface of the shoe.

12. The system of claim 1, further comprising a shield configured to at least partially surround the duct and each of the tubes and configured to be movable along the longitudinal axis of the duct.

13. The system of claim 1, wherein the tube further comprises an outlet for directing at least a portion of the airflow into the shoe.

14. The system of claim 13, wherein the outlet of the tube is directed toward the toe end of the shoe.

15. A system for drying a shoe resting in an upright position, comprising:

a fan operable to produce an air flow;

a heating element;

at least one duct adapted to direct at least a portion of the airflow into a shoe, said duct having at least one outlet therein; and a vented bag having an inflated state upon operation of said fan, said vented bag having a proximal end for receiving said duct, a distal end opposite said proximal end, and a plurality of apertures formed adjacent said distal end of said bag, said apertures being positioned above the toe of a shoe to be dried when the vented bag is in said inflated state.

16. The system of claim 15, wherein said apertures are of sufficient size to maintain said vented bag in an inflated state upon operation of said fan.

17. The system of claim 15, further comprising a at least one tube extending from the duct and configured to contact an interior surface of the shoe.

18. A system for drying a shoe comprising;

a fan operable to produce an airflow;

a heating element;

a duct for directing the air flow into a shoe, said duct having at least one outlet therein; and a fixed-bladed device positioned within a portion of said duct for generating turbulent airflow along substantially the interior length of a shoe.

19. The system of claim 18, wherein the fixed-bladed device comprises a planar portion and plurality of outwardly flanges extending from the planar portion and forming an obtuse angle therewith.

20. A process for drying a shoe, comprising the steps of:

providing a shoe;

providing a drying system comprising a fan operable to produce an air flow, a heating element, a duct having an outlet, and a tube extending from said duct and configured to be positioned within the shoe, wherein said drying system has a drying effectiveness of at least about 70 g/hr;

inserting said duct and tube into said shoe; and directing an air flow to the interior of said shoe.

21. The process of claim 20, wherein said step of supplying an airflow continues for less than one hour.

22. The process of claim 20, wherein said drying system further comprises a turbulence generating device.

23. The process of claim 22, wherein said turbulence generating device comprises a blade.

24. The process of claim 20, further comprising a vented bag for receiving said shoe and said duct having an airflow exiting said bag.

25. The process of claim 24, wherein said airflow exiting said bag has a relative humidity of about 20%.

26. The process of claim 20, further comprising the step of immersion washing said shoe prior to said supplying step.

27. A process for drying a shoe, comprising the steps of:

providing a shoe;

immersion washing said shoe;

providing a drying system comprising a fan operable to produce an air flow, a heating element, a duct having an outlet and a fixed-bladed device positioned within a portion of said duct for generating turbulent airflow;

inserting said duct into said shoe;

directing said airflow to the interior of said shoe; and maintaining said airflow to provide a drying effectiveness of at least 70 g/hr within the first hour of drying.

* * * * *